US007478496B2

(12) United States Patent
Bender

(10) Patent No.: US 7,478,496 B2
(45) Date of Patent: Jan. 20, 2009

(54) SELF-STABILIZING BIPOD

(76) Inventor: Terrence Dwight Bender, 5250 Annapolis Ln. N., Plymouth, MN (US) 55446

( * ) Notice: Subject to any disclaimer, the term of this patent is extended or adjusted under 35 U.S.C. 154(b) by 184 days.

(21) Appl. No.: 11/585,377

(22) Filed: Oct. 24, 2006

(65) Prior Publication Data

US 2007/0094912 A1 May 3, 2007

Related U.S. Application Data

(60) Provisional application No. 60/731,334, filed on Oct. 28, 2005.

(51) Int. Cl.
*F41A 23/10* (2006.01)
*F16M 11/06* (2006.01)

(52) U.S. Cl. ..... 42/94; 89/37.04; 248/176.1

(58) Field of Classification Search ..... 42/94; 89/37.04; 248/176.1, 176.3; D22/108
See application file for complete search history.

(56) References Cited

U.S. PATENT DOCUMENTS

| | | | | | |
|---|---|---|---|---|---|
| 1,382,409 | A * | 6/1921 | Butler | 42/94 |
| 1,524,973 | A * | 2/1925 | Hazelton | 42/94 |
| 1,580,406 | A * | 4/1926 | Browning | 42/94 |
| 2,807,904 | A * | 10/1957 | Kreske | 42/94 |
| 3,235,997 | A * | 2/1966 | Stoner | 42/94 |
| 3,745,879 | A | 7/1973 | Asikainen et al. | 89/37 |
| 4,397,112 | A | 8/1983 | York | 42/94 |
| 4,903,425 | A * | 2/1990 | Harris | 42/94 |
| 5,074,188 | A | 12/1991 | Harris | 89/37.04 |
| 5,852,892 | A | 12/1998 | Bilgeri et al. | 42/94 |
| 6,289,622 | B1 | 9/2001 | Desch, Jr. et al. | 42/94 |
| 6,763,627 | B1 | 7/2004 | Kaempe | 42/94 |
| 6,785,997 | B2 * | 9/2004 | Oz | 42/94 |
| 6,829,857 | B1 * | 12/2004 | Houtsma | 42/94 |
| 6,920,713 | B1 * | 7/2005 | Love | 42/94 |
| 2005/0188596 | A1 * | 9/2005 | Wygant | 42/94 |
| 2005/0242250 | A1 | 11/2005 | Keng et al. | 248/168 |

OTHER PUBLICATIONS www.defensereview.com, Accuracy International AS50 Semi-Auto .50 BMG Rifle for U.S. Navy SEALs.
U.S. Appl. No. 60/731,334, filed Oct. 28, 2005, Terrence Bender.

* cited by examiner

*Primary Examiner*—Bret Hayes
(74) *Attorney, Agent, or Firm*—Vidas, Arrett & Steinkraus, P.A.

(57) ABSTRACT

In at least one embodiment, a firearm support assembly comprises a mounting ring that is constructed and arranged to extend around a gun barrel and to be rotatably engaged with a portion of the firearm. The mounting ring defines a central axis. A plurality of legs are attached to the mounting ring at a location above the central axis, and each leg extends downwardly below the central axis.

20 Claims, 12 Drawing Sheets

SELF-STABILIZING BIPOD

CROSS-REFERENCE TO RELATED APPLICATIONS

This Application claims the benefit of U.S. Provisional Application No. 60/731,334, filed Oct. 28, 2005, the entire contents of which are hereby incorporated herein by reference.

BACKGROUND OF THE INVENTION

This invention relates generally to firearms and more specifically to a stabilizing support for a firearm, such as a bipod.

Shooters have long employed bipods (two legged stands) to lift the fore stock of rifles off the ground for level targeting when shooting in the prone position, freeing the non-trigger hand for other purposes. The bipod is sometimes used to prop the fore stock of the rifle when in other positions, like sitting or standing, behind an obstacle for concealment, or as a prop.

Bipod designs are ubiquitous. Most employ folding features where the bipod legs can be folded down (perpendicular to the barrel) when shooting and folded up (parallel to the rifle barrel) for storage or stowage. Various spring detente features are employed that fix the fold locations. Most bipods also employ various means to alter an adjustable length of either of the two legs to accommodate different shooting angles of muzzle elevation (angles from rifle butt to muzzle), ground horizon inclines (angles from the left hand to the right hand positions of the shooter, which are perpendicular to the rifle barrel), and combinations of these, to allow the shooter to maintain the rifle optical sighting scope axis and barrel axis in the vertical plane for accurate sighting of the target, wherever it might be.

The bipods usually attach to the underside of the rifle fore stock and usually employ a pivot feature to allow the shooter to make small adjustments in the sight picture without changing the position of the bipod legs, or the resting position of the bipod feet on the ground. Some rifle manufacturers have attached an appendage to the rifle receiver itself, eliminating the fore stock altogether, or free-floated the barrel, to which appendage a bipod may attach in a forward position near where a bipod would attach on a fore stock, if there were one.

Prior art bipods that allow adjustment of projectile trajectory without moving the contact points between the bipod legs and the supporting ground generally place a pivot location on the underside of the rifle. This allows the rifle to tilt to the left or right about the pivot point, which creates an inherent instability associated with the preferred central position. The unstable center position causes the rifle to behave like an inverted pendulum, tending to fall precipitously either to the left or to the right under the influence of gravity, and requiring the shooter to apply stabilizing forces to the rifle. Thus, the most stable positions under the influence of gravity are when the rifle is fully tilted to one side or the other at the maximum travel allowed by the pivot mechanism. When the rifle is oriented in a tilted side position, the rifle sight and barrel axis do not lie in a vertical plane. This results in bullet trajectories that do not lie in a vertical plane, causing the bullet to fly either too far to the right or too far to the left. Moreover, when shooting at very long ranges, the time it takes to acquire and track the target if moving can be long, making steadiness of the sight picture progressively more difficult as time goes on.

There remains a need for new firearm support system designs that are inherently stable under the influence of gravity.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In at least one embodiment, a firearm support assembly comprises a mounting ring that is constructed and arranged to extend around a gun barrel and to be rotatably engaged with a portion of the firearm. The mounting ring defines a central axis. A plurality of legs are attached to the mounting ring at a location above the central axis, and each leg extends downwardly below the central axis.

In at least one other embodiment, a firearm support assembly comprises a barrel shroud having a central axis, an upper portion and a lower portion. The upper portion is oriented above the central axis and the lower portion is oriented below the central axis. A mount is rotatably engaged with the barrel shroud and arranged to rotate around the barrel shroud. At least a portion of the mount overlays at least a portion of the upper portion of the barrel shroud. First and second legs are also attached to the mount.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
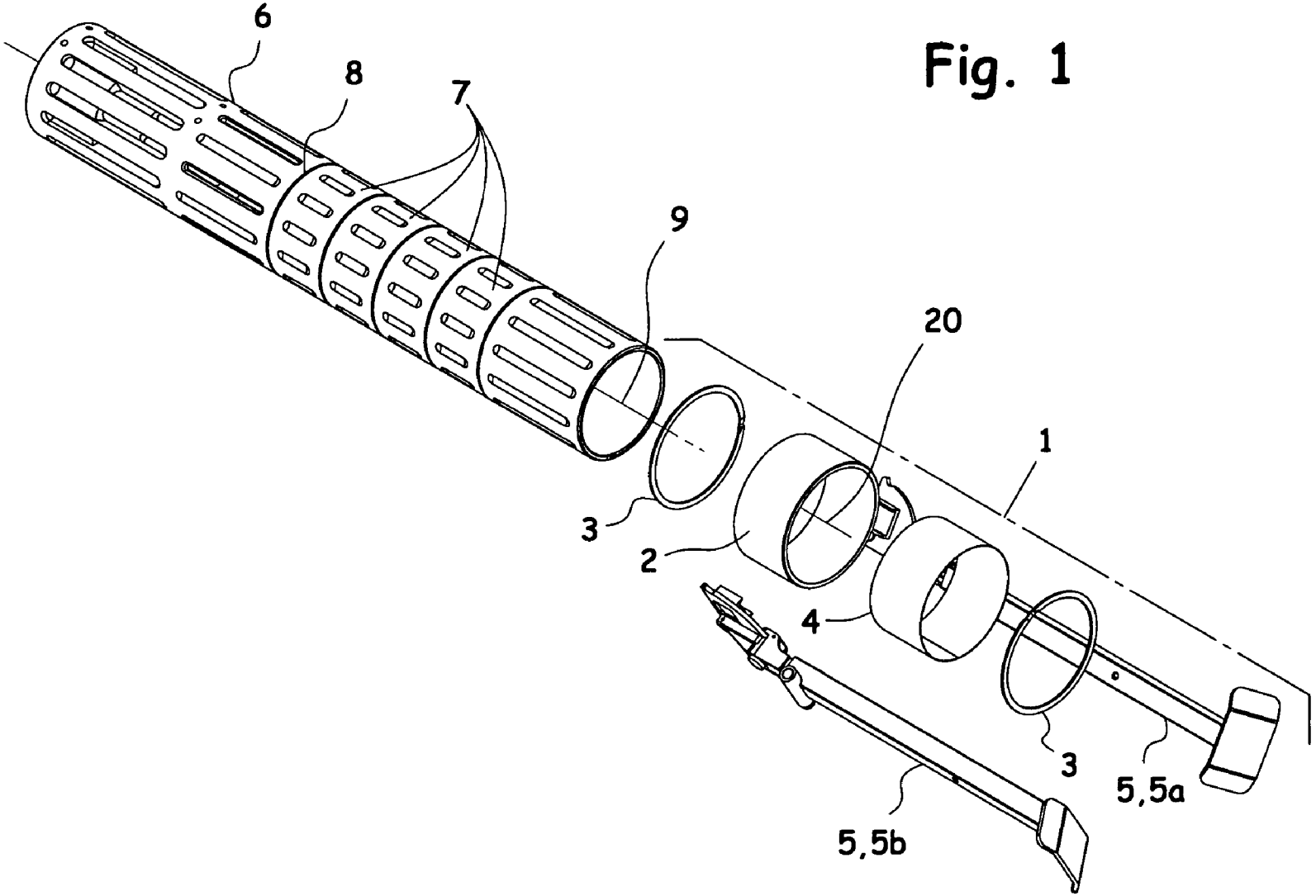
FIG. 1 shows an exploded view of an embodiment of a support system.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an exploded view of an embodiment of a bipod support system 1 for a firearm comprising a mount 2 and a plurality of legs 5. The mount 2 is constructed and arranged to rotatably engage a portion of a firearm, such as a barrel shroud 6. In some embodiments, the legs 5 are foldable and/or reversibly extensible.

The mount 2 can have any suitable shape and in some embodiments comprises a mounting ring defining a central axis 20. In some embodiments, the mount 2 can be cylindrical in shape, comprising a height dimension measured along the central axis 20.

In some embodiments, the support system 1 further comprises a portion of a firearm that is arranged to receive the mount 2.

FIG. 1 shows a barrel shroud 6 that is arranged to receive the mount 2 at one of a plurality of mounting locations 7. The barrel shroud 6 comprises a central axis 9 and a tubular shape. In some embodiments, the barrel shroud 6 is cylindrical. Each mounting location 7 comprises an external bearing surface around which the mount 2 can be rotatably engaged. The mount 2 can be oriented coaxially around the barrel shroud 6 and positioned over one of the mounting locations 7 such that the inner surface of the mount 2 bears upon the external bearing surface of the mounting location 7.

The mount 2 can be rotationally engaged to the barrel shroud 6 using any suitable engagement mechanism. In some embodiments, a retaining ring 3 can be positioned on each side of the mount 2 and attached to the barrel shroud 6, thereby bracing the mount 2 against axial travel along the length of the barrel shroud 6.

In some embodiments, the barrel shroud 6 can include a plurality of grooves 8 for receiving the retaining rings 3. The various pairs of grooves 8 can define multiple mounting locations 7. The barrel shroud 6 preferably includes at least two grooves 8 for each mounting location 7.

The multiple mounting locations 7 allow a shooter to adjust the specific location on the barrel shroud 6 to which the bipod support system 1 provides support, thereby allowing the shooter to balance the firearm as desired.

In some embodiments, the bipod support system 1 further comprises a bearing membrane 4 oriented between the barrel shroud 6 and the mount 2. A bearing membrane can minimize friction and wear between the barrel shroud 6 and the mount 2. A bearing membrane 4 can comprise any suitable material, for example a polymer such as polytetrafluoroethylene, expanded polytetrafluoroethylene, Acetal, etc.; suitable ultra-high molecular weight plastics; and other materials that exhibit high lubricity and/or provide reduced friction. In some embodiments, a bearing membrane 4 can comprise impregnated journal bearing materials, for example being impregnated with expanded polytetrafluoroethylene or any other suitable composition. In some embodiments, a bearing membrane 4 can comprise a tape that can include an adhesive backing. In some embodiments, a bearing membrane 4 can comprise a coating such as a polymer film, flash chrome, various ceramic finishes, etc.

In some embodiments, a bearing assembly can be used in place of the illustrated bearing membrane 4. A bearing assembly can comprise any suitable assembly having bearings, such as ball bearings, needle bearings, journal bearings, etc.

In some embodiments, the bearing membrane 4 can be fixedly attached to the mount 2. The bearing membrane 4 is preferably sized with enough clearance between the bearing membrane 4 and the barrel shroud 6 to allow the support system 1 to freely rotate around the shroud 6. Various embodiments of a bearing membrane 4 can be selected to provide various amounts of rotation resistance as desired by a shooter.

Figure 2:
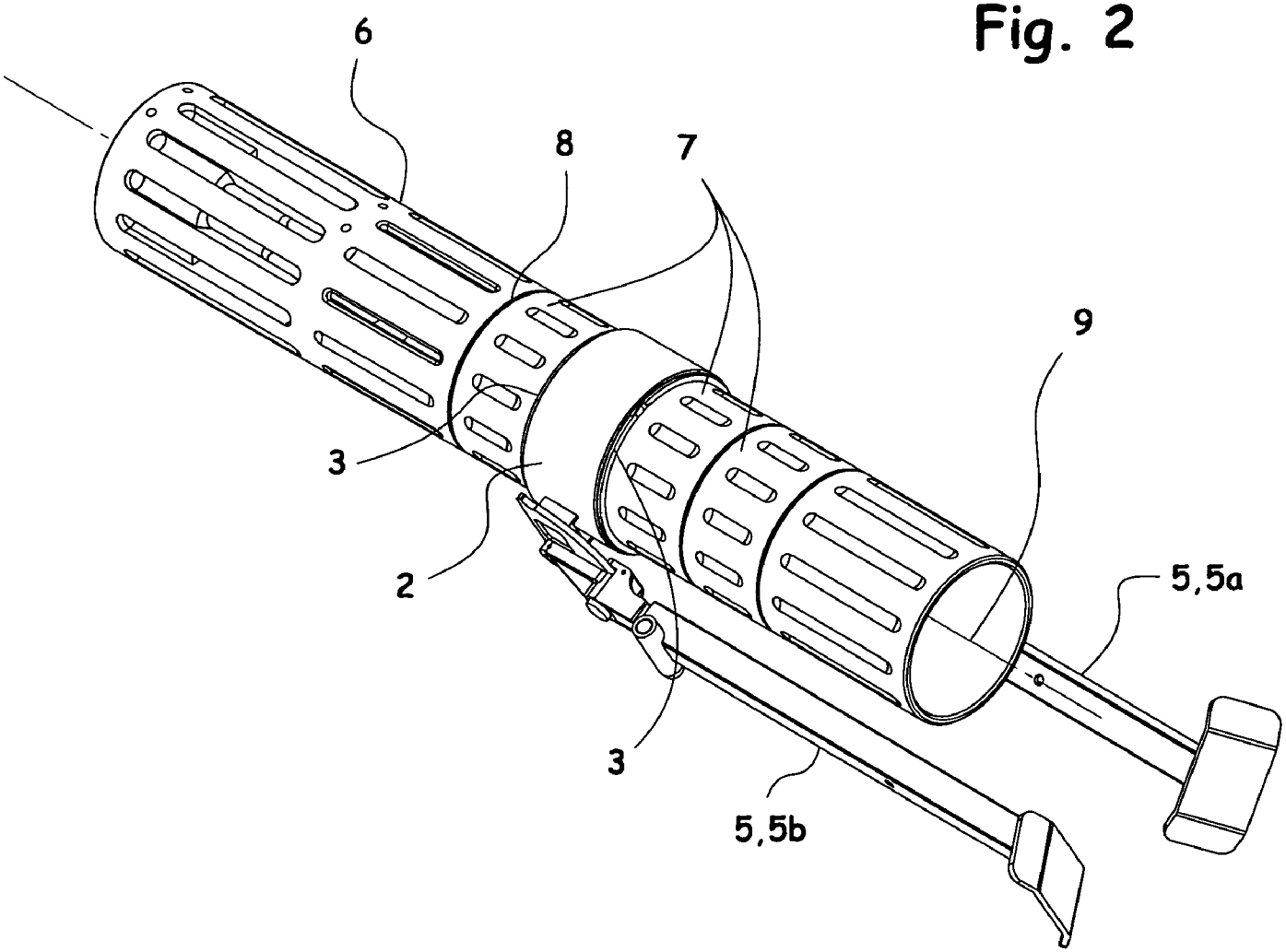
FIG. 2 shows an assembled embodiment of a support system.

FIG. 2 shows the embodiment of FIG. 1 in an assembled arrangement with the mount 2 rotatably engaged with the barrel shroud 6. The bearing membrane 4 is disposed between the barrel shroud 6 and the mount 2, and is thus hidden from view, along with the mounting location 7 over which the mount 2 is positioned.

The retaining rings 3 are positioned in grooves 8 on either side of the mount 2. The retaining rings 3 abut the mount 2 and prevent the mount 2 from axial displacement with respect to the shroud 6. The mount 2 is freely rotatable around the barrel shroud 6, in either direction, a full 360 degrees.

The bipod legs 5 are attached to the mount 2. The legs 5 are shown in a stowed configuration, oriented such that a longitudinal axis of each leg 5 is substantially parallel to central axis 9 of the barrel shroud 6.

Figure 3:
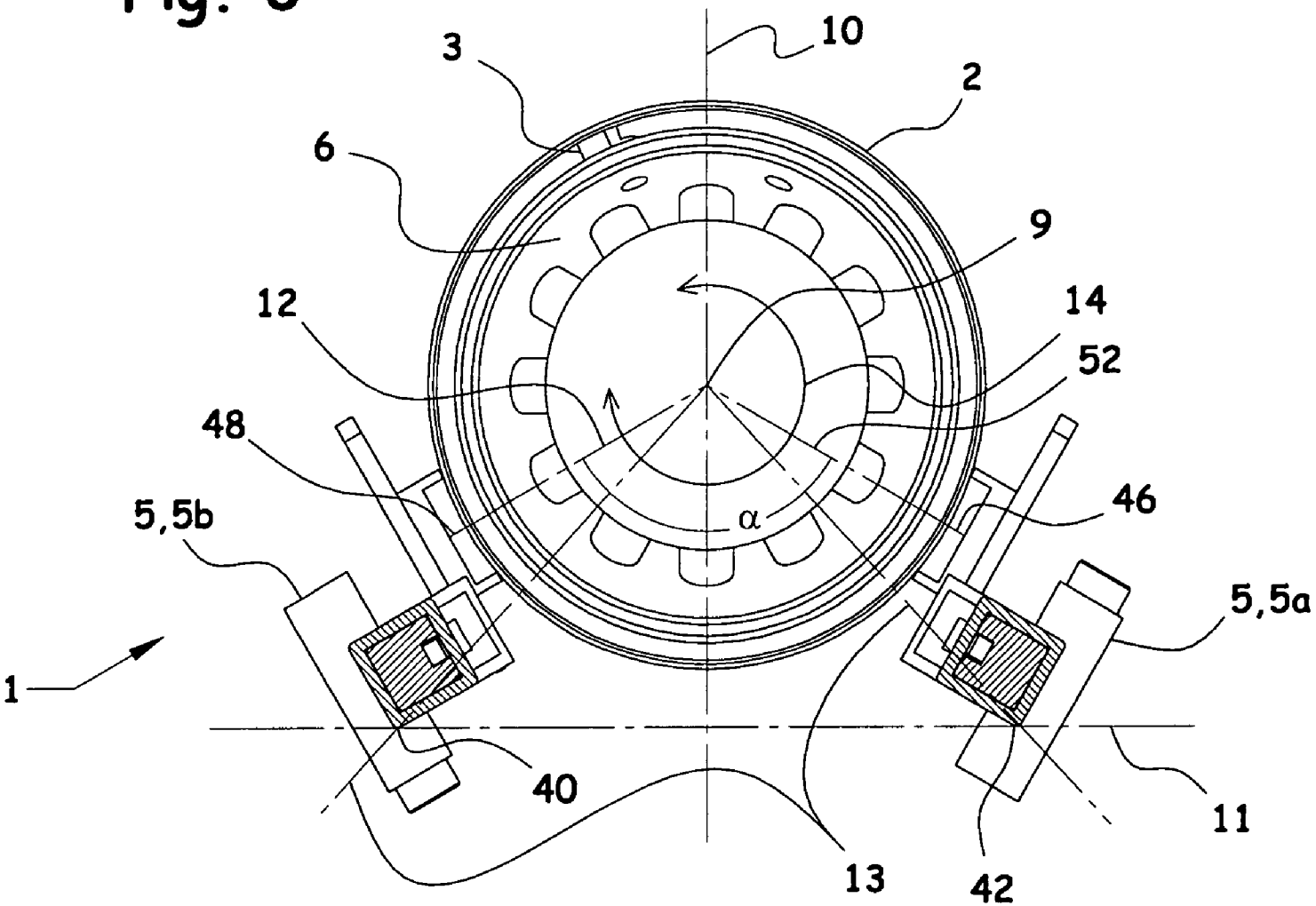
FIG. 3 is an end view of the embodiment of FIG. 2.

FIG. 3 shows an end view of the embodiment of FIG. 2, for example looking from the rifle muzzle toward the rifle butt. The legs 5 are in a stowed position and a portion of each leg 5 has been cut in cross-section. Because the mount 2 is freely rotatable around the barrel shroud 6, as indicated by rotation arc 14, the support system 1 will naturally assume the orientation shown in FIG. 3 under the influence of gravity when the legs 5 in the stowed position.

The legs 5 are shown resting upon a horizontal line 11 that can represent a supporting surface. The horizontal line 11 includes two contact points 40, 42, each contact point 40, 42 representing a support location where a leg 5 can be supported by a supporting surface. A vertical sight plane 10 is shown that intersects the central axis 9 of the barrel shroud 6. Because the supporting surface is horizontal, the vertical sight plane 10 is substantially perpendicular to the horizontal line 11.

A leg contact axis 13 is shown for each leg 5. Each leg contact axis 13 extends from the central axis 9 of the barrel shroud 6 through a contact point 40, 42. Each leg contact axis 13 is also perpendicular to the barrel shroud 6 at the location where the axis 13 intersects the barrel shroud 6. The leg contact axes 13 and the horizontal line 11 collectively form a structurally stable triangle. The apex point of the triangle intersects central axis 9 of the barrel shroud 6. In the embodiment shown, supporting forces from the legs 5 are transmitted through the mount 2 to the barrel shroud 6 via the bearing engagement between the mount 2 and the shroud 6. Note that a shooter can rotate the barrel shroud 6, and therefore the rifle, freely within the mount 2 as desired without upsetting the stability provided by the triangle.

In some embodiments, the legs 5 comprise a first leg 5*a* and a second leg 5*b*. The first leg 5*a* attaches to the mount 2 at a first attachment location 46. The second leg attaches to the mount 2 at a second attachment location 48. A first leg normal line 12 extends from the central axis 9 of the barrel shroud 6 to the first attachment location 46. A second leg normal line 52 extends from the central axis 9 of the barrel shroud 6 to the second attachment location 48.

The angle α formed between the first leg normal line 12 and the second leg normal line 52 can impact the stability of the support system 1. Various embodiments can have an angle α ranging from as small as possible to 180 degrees. The embodiment of FIG. 3 includes an angle α of approximately 120 degrees. In some preferred embodiments, the angle α can range from 90 degrees to 140 degrees.

Figure 4:
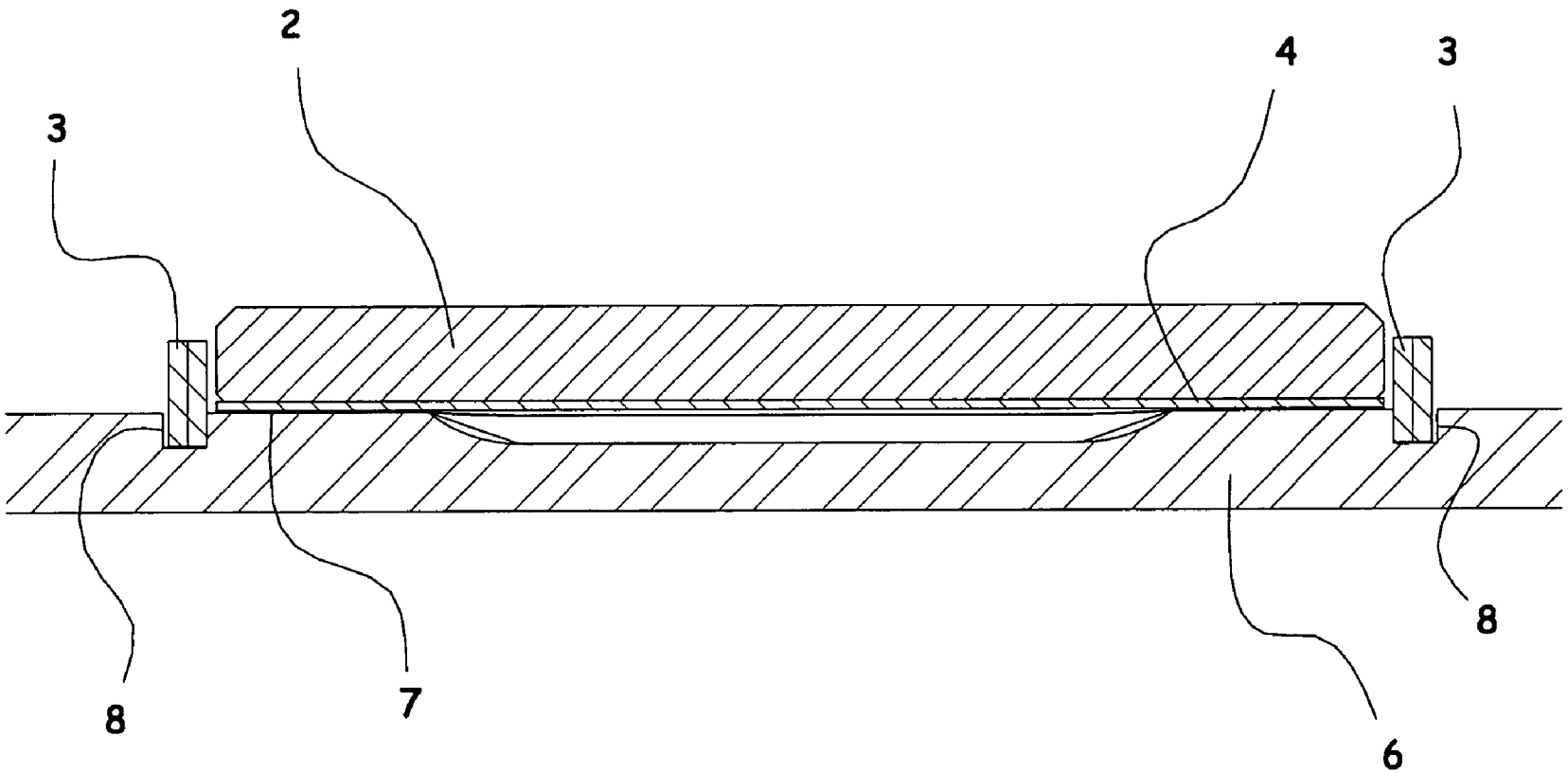
FIG. 4 is a partial sectional view of an embodiment of a support system.

FIG. 4 shows a cross-sectional view of a portion of the barrel shroud 6 and support system 1. The cross-section is taken in a direction parallel to the central axis 9 of the barrel shroud 6. The mount 2 overlays the barrel shroud 6, and the bearing membrane 4 is oriented between the mount 2 and the barrel shroud 6. Retaining rings 3 are positioned on either side of the mount 2 in the grooves 8 formed in the outer surface of the barrel shroud 6. The retaining rings 3 extend outwardly from the barrel shroud 6 and prevent the mount 2 from sliding longitudinally with respect to the barrel shroud 6.

Figure 5:
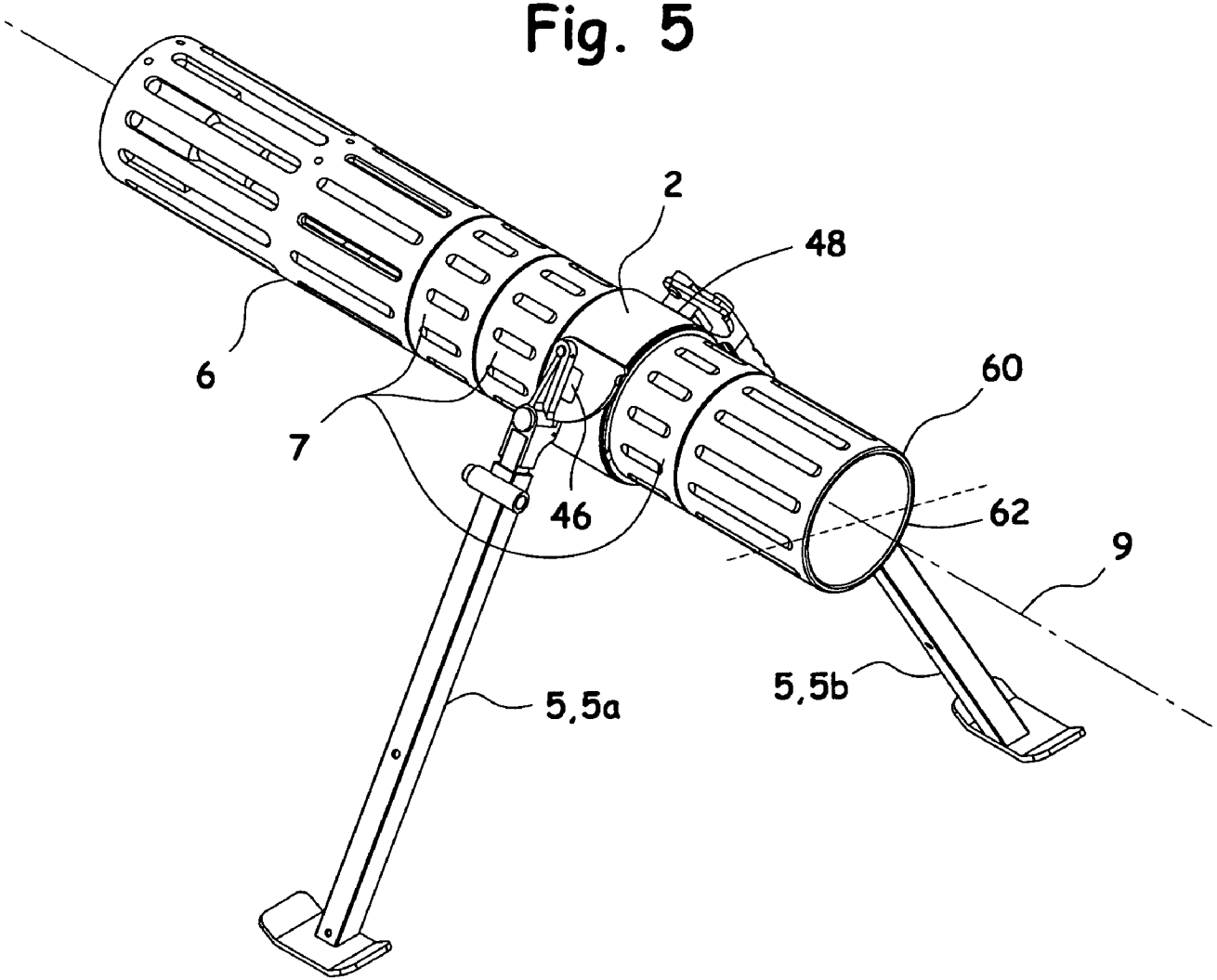
FIG. 5 shows the embodiment of FIG. 1 in an alternate configuration.

FIG. 5 shows the embodiment of FIG. 2 in another configuration with the bipod legs 5 folded down, or deployed. The mount 2 has been rotated approximately 180 degrees with respect to the barrel shroud 6 from the position shown in FIG. 2. The attachment locations 46, 48 between the legs 5 and the mount 2 are now oriented over the upper half of the barrel shroud 6, at locations above the central axis 9 of the barrel shroud 6. More specifically, the barrel shroud 6 can comprise an upper portion 60 and a lower portion 60, wherein the upper portion 60 is located above the central axis 6. At least a portion of the mount 2 and the attachment locations 46, 48 overlay a portion of the upper portion 60 of the barrel shroud 6.

Figure 6:
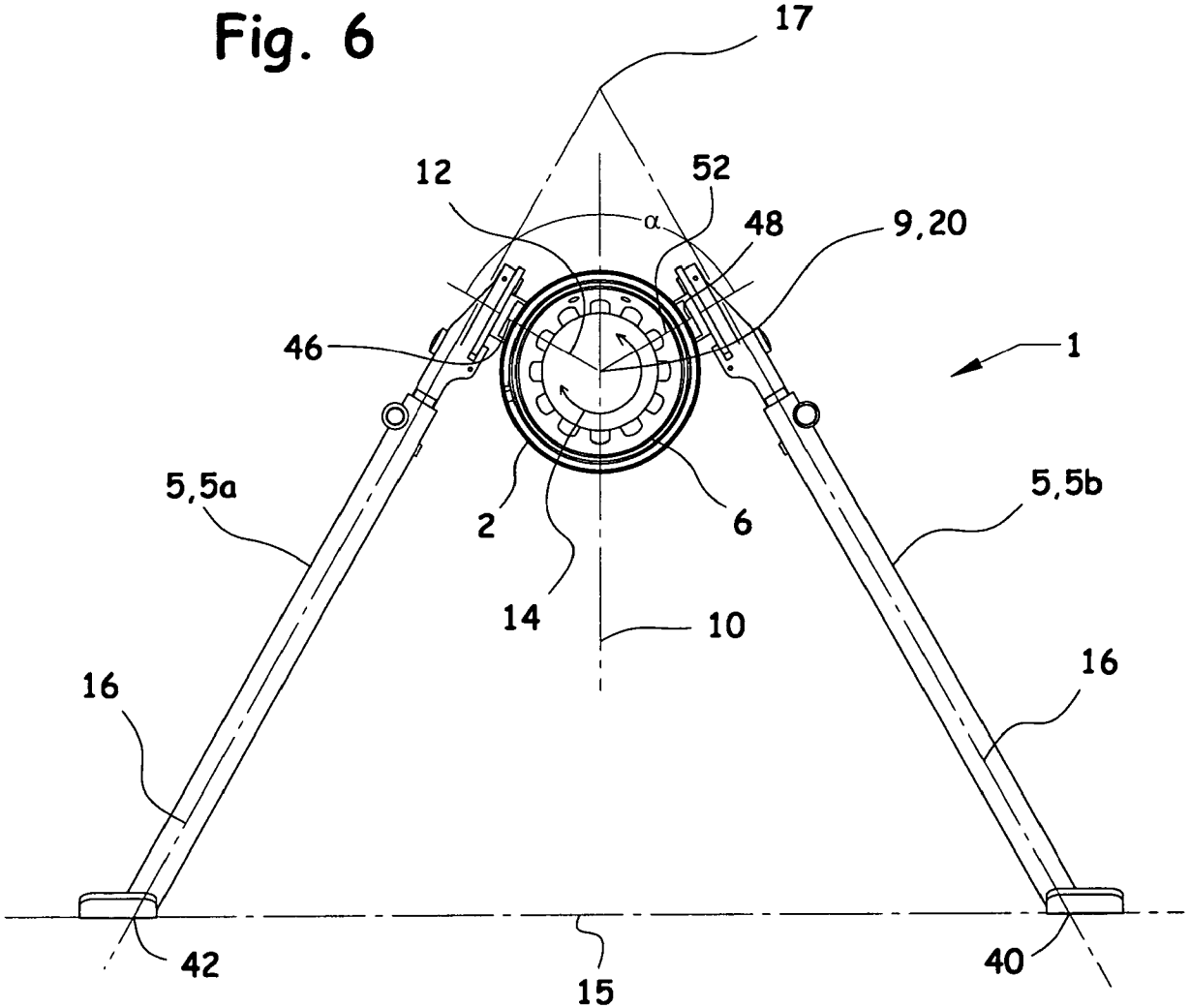
FIG. 6 shows an end view of the configuration of FIG. 5.

FIG. 6 shows an end view of the configuration shown in FIG. 5. The mount 2 is oriented coaxially with the barrel shroud 6, and thus the attachment locations 46, 48 between the legs 5 and the mount 2 are oriented above the central axis 20 of the mount 2. Each leg 5 extends downwardly below the central axis 20 of the mount 2. The leg normal lines 12, 52 are now oriented in an upward direction, reversed from the positioning shown in FIG. 2. The angle α between the leg normal lines 12, 52 is oriented in an upward direction. When the legs 5 are deployed, the support system 1 will assume the orientation shown in FIG. 6 under the influence of gravity.

A horizontal line 15 representing a support surface is shown, intersecting contact points 40, 42 between the support surface and the legs 5. The longitudinal axes 16 of the legs 5 intersect at a location 17 above the barrel shroud 6. The intersection location 17 also intersects the vertical sight plane 10. Supporting forces from the legs 5 are transmitted through the mount 2 to the barrel shroud 6 via the bearing engagement between the mount 2 and the shroud 6. The support provided to the mount 2 from the legs 5 is symmetrical across the vertical sight plane 10. This configuration is inherently stable because the center of mass of the supported portion of the firearm is located within the support triangle formed by the contact points 40, 42 and the intersection location 17. This configuration is further inherently stable because the attachment points 46, 48 are located above the central axis 9 of the supported barrel shroud 6. The barrel shroud 6, and thus the firearm, remains free to rotate with respect to the mount 2 without disturbing stability of the support system 1, as indicated by rotation arc 14.

Figure 7:
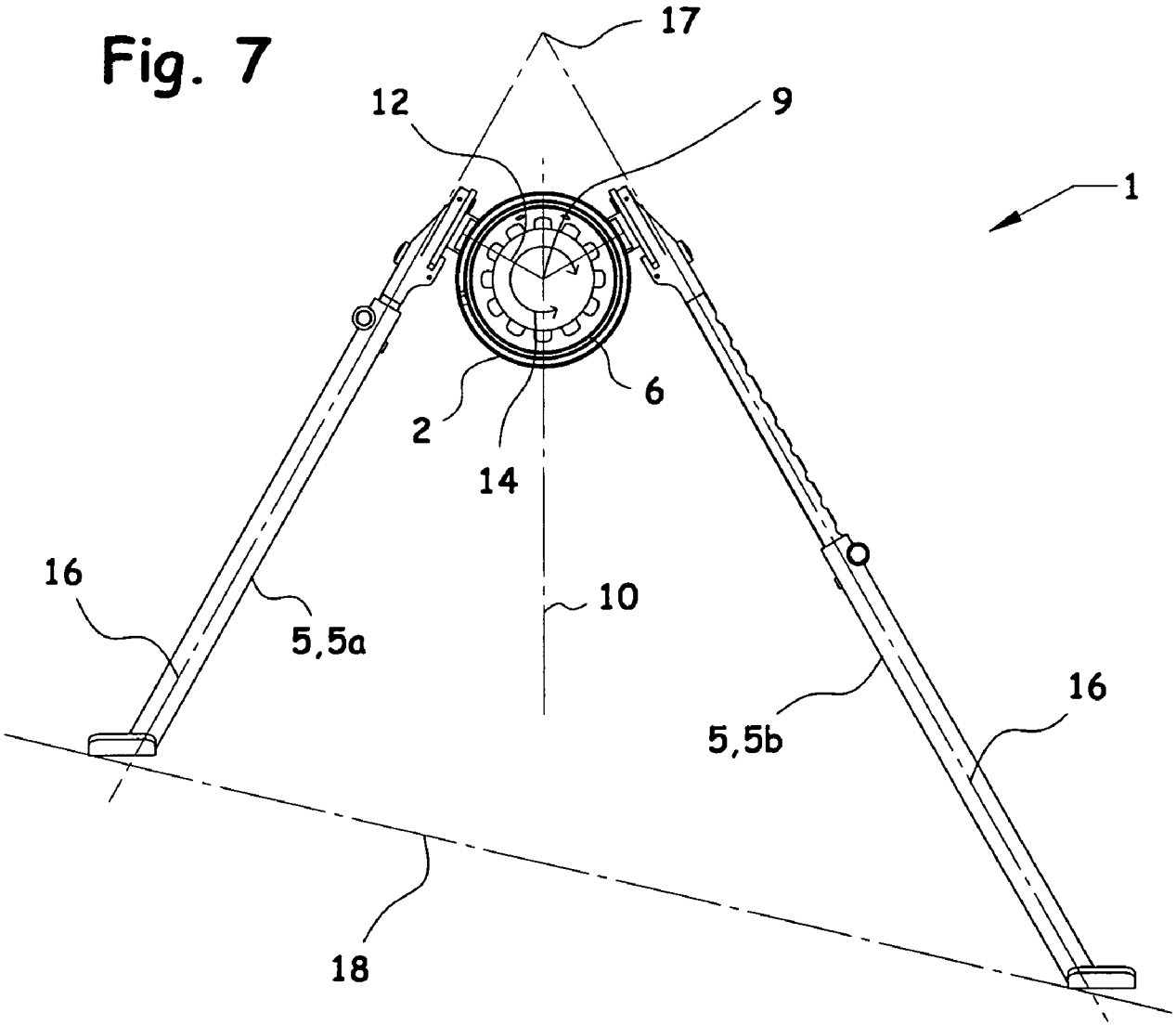
FIG. 7 shows an end view of an embodiment of a support system on a non-horizontal surface having one leg extended.

FIG. 7 shows the embodiment of FIG. 6 supported by a non-horizontal support surface, represented by non-horizontal contact line 18. The first leg 5*a* has been extended and comprises a greater length than the second leg 5*b*. Extension of the first leg 5*a* allows the support system 1 to be used with a non-horizontal support surface while still allowing the intersection location 17 between the longitudinal axes 16 of the legs 5*a*, 5*b* to be oriented in the vertical sight plane 10.

Figure 8:
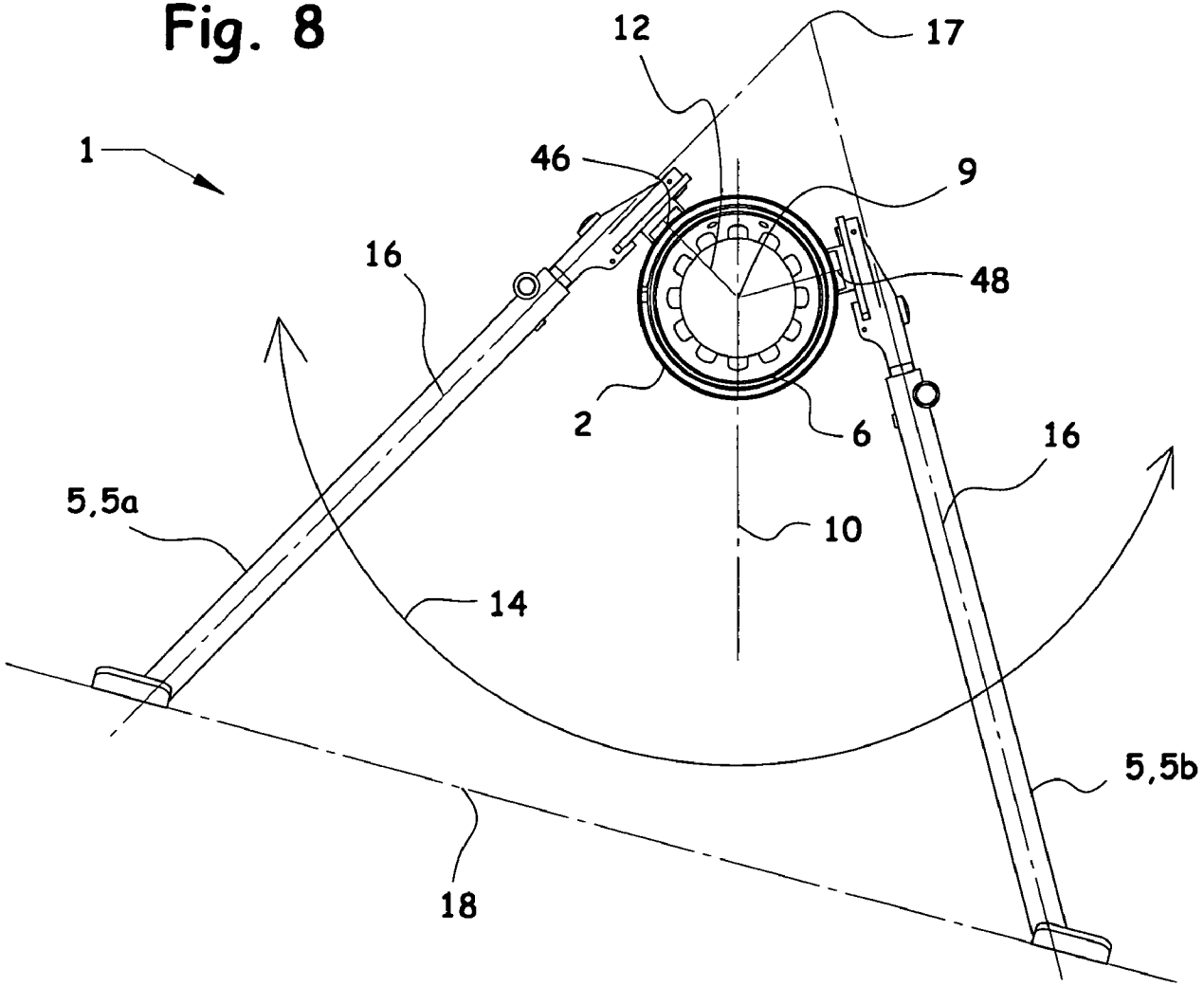
FIG. 8 shows an end view of an embodiment of a support system on a non-horizontal surface when the legs have the same length.

FIG. 8 shows the embodiment of FIG. 6 supported by a non-horizontal support surface, represented by non-horizontal contact line 18. Neither leg 5 has been extended and thus both legs 5 comprise the same length.

The rotational engagement between the mount 2 and the barrel shroud 6 allows the support system 1 to quickly and automatically assume an inherently stable orientation. The support system 1 will rotate with respect to the barrel shroud 6, as represented by rotation arc 14, until both legs 5 are properly supported by the supporting surface. The barrel shroud 6, and thus the firearm, is free to rotate and assume a position where the rifle sights and barrel lie in the vertical sight plane 10.

Although the intersection location 17 between the longitudinal axes 16 of the legs 5 is not oriented in the vertical sight plane 10, the support provided to the mount 2 by the legs 5 is not symmetrical across the vertical sight plane 10. However, because the mount 2 supports the barrel shroud 6 via the rotatable bearing engagement, the support provided to the barrel shroud 6 by the mount 2 is symmetrical across the vertical sight plane 10.

The configuration shown in FIG. 8 remains inherently stable as the support provided to the mount 2 at the attachment locations 46, 48 remains above the central axis 9 of the barrel shroud 6. Thus, the weight of the supported firearm works to balance the support system 1. The center of mass of the supported portion of the firearm (e.g. the barrel and barrel shroud 6), like a pendulum seeking the lowest and most stable position, is still within the triangle formed by the non-horizontal support line 18 and the longitudinal axes 16 of the legs 5.

Figure 9:
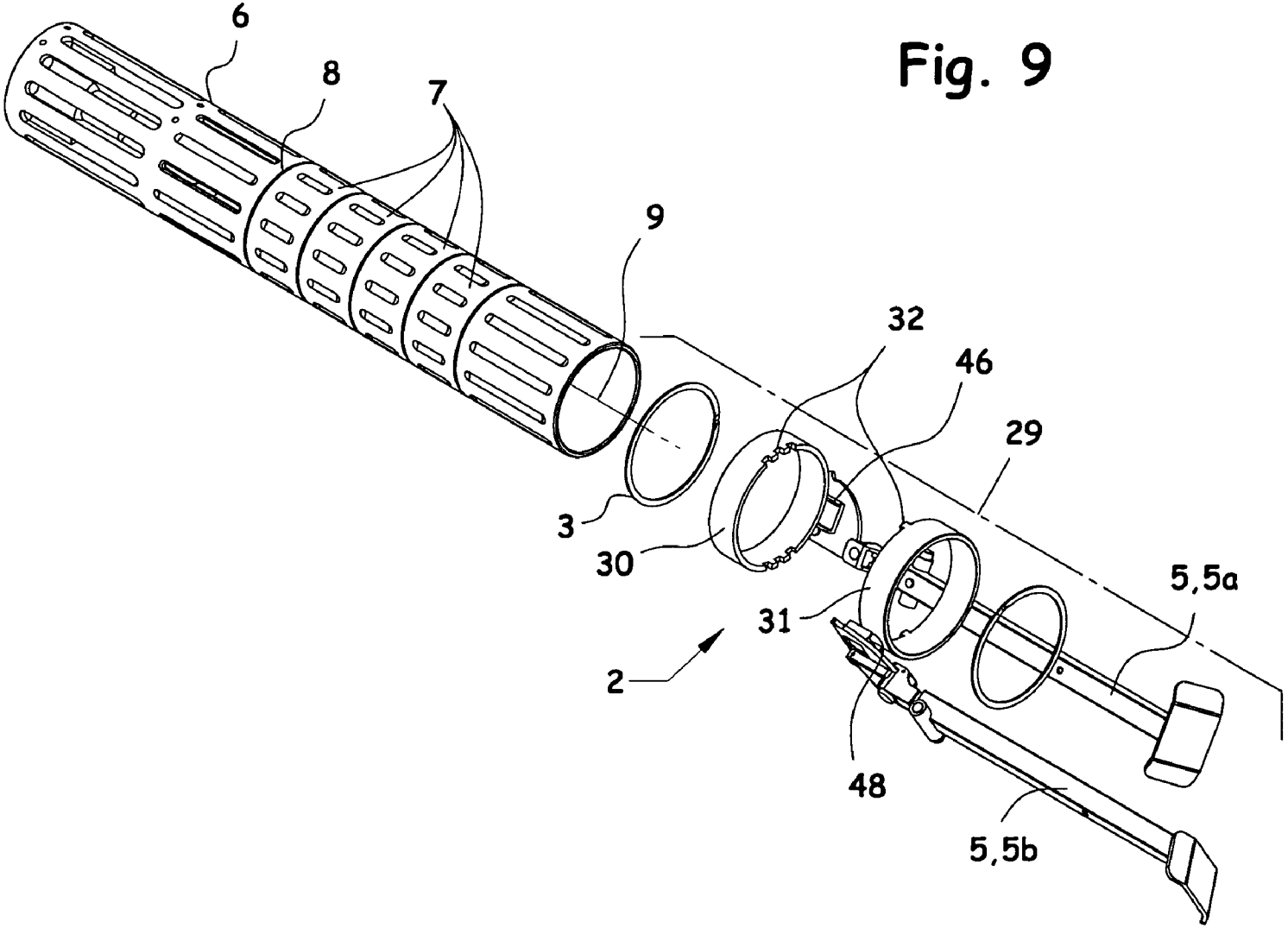
FIG. 9 shows an embodiment of a support system where the leg attachment locations can be adjusted with respect to one another.

FIG. 9 shows another embodiment of a mount 2, wherein the angle α formed between the first leg normal line 12 and the second leg normal line 52, as shown in FIGS. 3 and 6, is adjustable.

The mount 2 comprises a first portion 31 and a second portion 30. The first leg 5*a* is attached to the first portion 31 at a first attachment location 46. The second leg 5*b* is attached to the second portion 30 at a second attachment location 48. The first portion 31 is adjustable with respect to the second portion 30 such that the rotational distance between the first attachment location 46 and the second attachment location 48 is adjustable.

In some embodiments, a mount 2 that comprises a first portion 31 and a second portion 30 comprises a plurality of detents 32 at predetermined rotational alignments. As shown in FIG. 9, the first portion 31 comprises as least one protrusion that is arranged to mate with one of a plurality of complimentary grooves or indentations in the second portion 30. Each indentation represents a change in the angle α formed between the first leg normal line 12 and the second leg normal line 52 (see FIGS. 3 and 6). In the embodiment shown, the adjacent indentations represent a 15 degree change in the angle α. Depending upon the indentation selected, the mount 2 of FIG. 12 can be arranged such that the angle α is 85 degrees, 120 degrees or 135 degrees. Various embodiments can be arranged to allow the angle α to have any suitable value, and also to be infinitely adjustable.

The first and second portions 31, 30 of the mount 2 of FIG. 9 are held against each other by the retaining rings 3 when the support system 1 is assembled. Thus, the rotational orientation of the first portion 31 is fixed with respect to the second portion 30 when the retaining rings 3 are in place.

Figure 10:
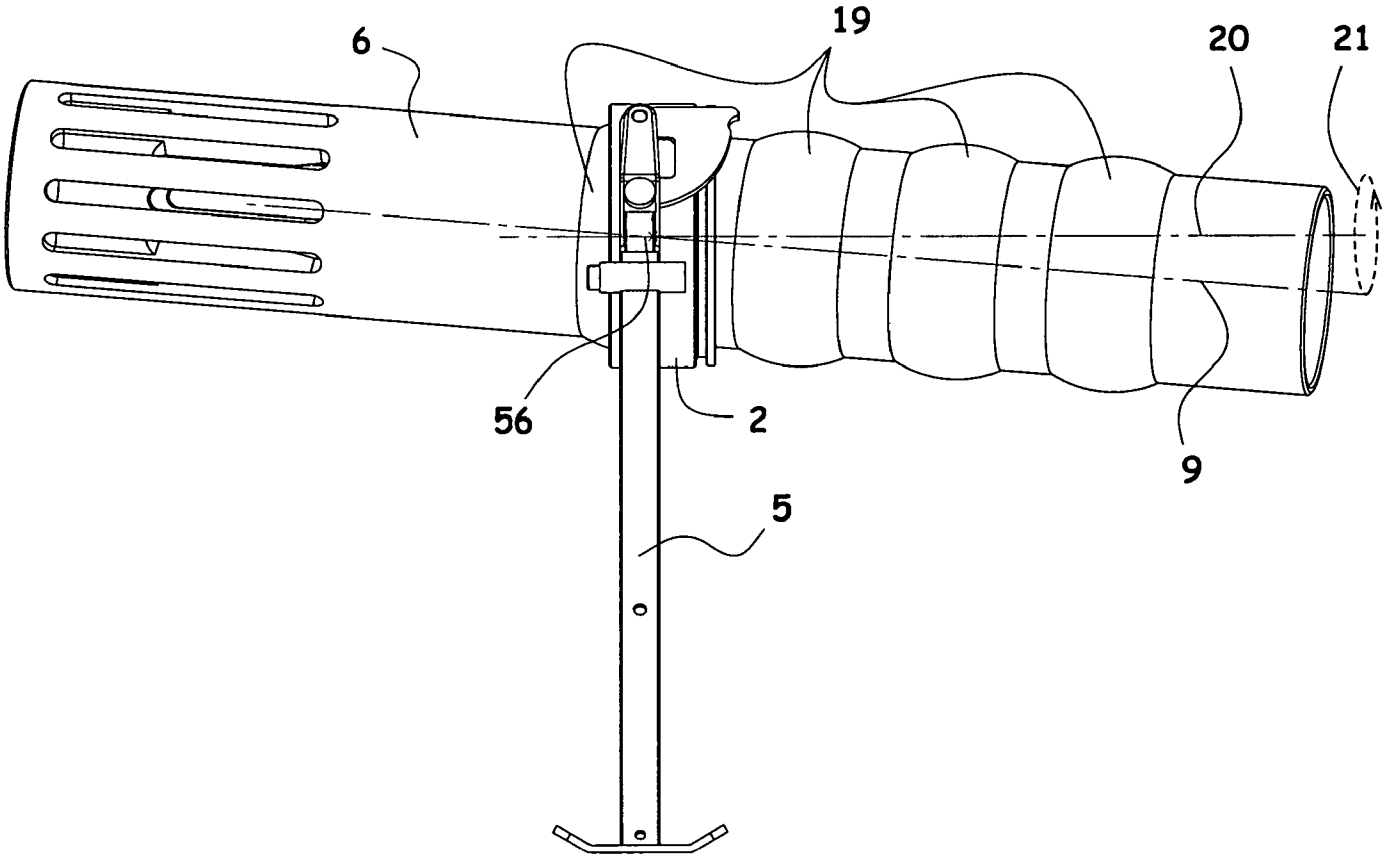
FIG. 10 shows an embodiment of a support system arranged to swivel in three dimensions.

FIG. 10 shows an embodiment of a support system 1 that supports a firearm as described herein and further allows the barrel shroud 6 to swivel in three dimensions with respect to the mount 2.

Figure 11:
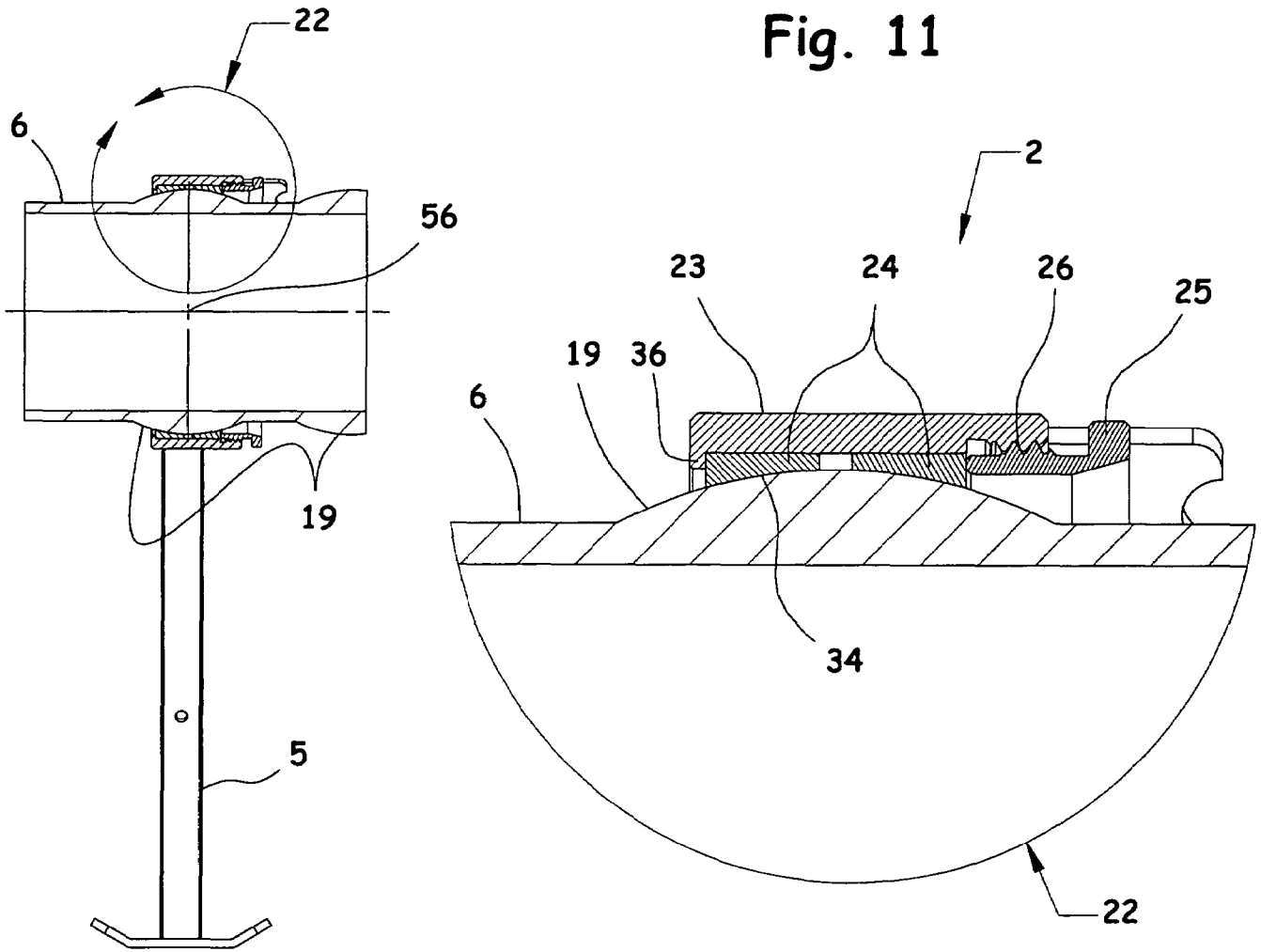
FIG. 11 shows a sectional view of the embodiment of FIG. 10.
Figure 12:
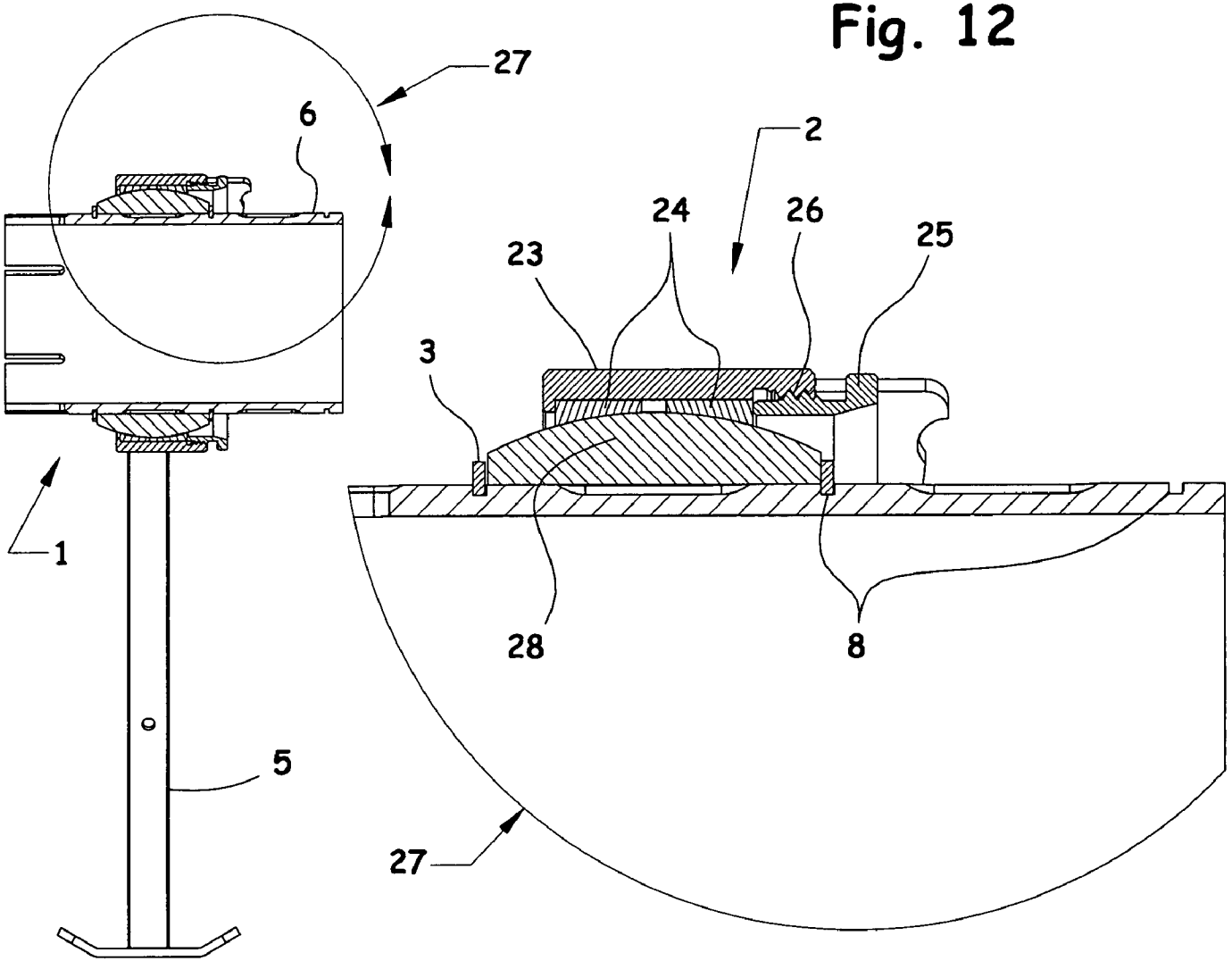
FIG. 12 shows a sectional view of another embodiment of a support system arranged to swivel in three dimensions.

The barrel shroud 6 comprises at least one convex outer surface 19. The convex outer surface 19 comprises three-dimensional convexity and includes curvature in a direction parallel to the central axis 9 of the barrel shroud 6. In some embodiments, a convex outer surface 19 comprises a spherical surface centered upon the center of rotation 56 between the barrel shroud 6 and the mount 2. The mount 2 includes a complimentary concave inner surface arranged to mate with the convex outer surface of the barrel shroud 6, for example as shown in FIGS. 11 and 12.

The swiveling engagement between the mount 2 and the barrel shroud 6 allows the central axis 20 of the mount 2 to move with respect to the central axis 9 of the barrel shroud 6. In a first orientation, the central axis 20 of the mount 2 can be parallel to the central axis 9 of the barrel shroud 6. In a second orientation, the central axis 20 of the mount 2 can be non-parallel to the central axis 9 of the barrel shroud 6, for example as shown in FIG. 10.

In some embodiments, the barrel shroud 6 can comprise a plurality of axially spaced convex outer surfaces 19. Each convex outer surface 19 represents a separate mounting location. Thus, the mounting location of the swivel mount 2 can be axially adjusted as desired by a shooter.

In some embodiments, a bearing membrane or lubricious coating can be included between the convex outer surface of the barrel shroud 6 and the concave inner surface of the mount 2.

FIG. 11 shows the embodiment of FIG. 10 in cross-section. The mount 2 comprises at least one concave inner surface 34 having three-dimensional concavity that includes curvature in a direction parallel to the central axis 9 of the barrel shroud 6. In some embodiments, the concave inner surface 34 comprises a spherical surface centered upon the center of rotation 56 between the barrel shroud 6 and the mount 2.

The embodiment of a mount 2 shown in FIG. 11 is further arranged to be removable, and thus comprises an outer mount 23, two gimble halves 24 and a gimble nut 25. Each gimble half 24 comprises a concave inner surface 34 having three dimensional concavity. In some embodiments, each gimble half 24 comprises a mirror image of the other.

The outer mount 23 includes an internal shoulder 36 arranged to abut one of the gimble halves 24. The other gimble half 24 is held in place by the gimble nut 25, which engages the outer mount 23, for example via screw threads 26 or any other suitable engagement mechanism.

The embodiment of a mount 2 shown in FIG. 11 is also arranged to lock with respect to the barrel shroud 6. When the gimble nut 25 is tightened against the outer mount 23 to a high degree, high friction between the gimble halves 24 and the barrel shroud 6 can function to clamp the position of the mount 2 against movement in any direction. If the gimble nut 25 is loosened an amount necessary to relieve the high frictional engagement, the mount 2 can rotate completely around the barrel shroud 6 and swivel as herein described. The surfaces of the interfacing components, whether spherical or cylindrical can be treated to enhance lubricity without the need for a separate lubricious bearing component 4 as described with respect to FIGS. 1-4.

Adjusting the size and shape of the components that include the convex outer surface 19 and the concave inner surface 34 allows for a change (e.g. increase or decrease) in the maximum amount of swivel angle allowed by the components.

FIG. 12 shows another embodiment of a support system 1 that allows the barrel shroud 6 to swivel in three dimensions with respect to the mount 2. The barrel shroud 6 comprises a cylindrical outer surface, for example as shown in FIG. 1. The barrel shroud 6 further comprises grooves 8 for receiving retaining rings 3. The mount 2 comprises gimble halves 24 and a gimble nut 25, for example as shown in FIG. 11.

The support system 1 further comprises a shroud ring 28 oriented between the mount 2 and the barrel shroud 6. The shroud ring 28 comprises a convex outer surface similar to the outer surface 19 as described with respect to FIG. 10.

The embodiment of FIG. 12 can be locked against swivel action by tightening the gimble nut 25 to a high degree as described above, thereby creating a high frictional engagement between the mount 2 and the shroud ring 28. Even when locked against swivel movement, the mount 2 and the shroud ring 28 remain free to rotate around the barrel shroud 6.

In some embodiments, a bearing membrane 4 as described with respect to FIGS. 1-4 can be included in the embodiment of FIG. 12, for example being disposed between the shroud ring 28 and the barrel shroud 6. The swiveling interaction between the shroud ring 28 and the mount 2 can further be lubricated using any suitable method.

While the support system 1 illustrated in the Figures generally shows the mount 2 rotatably engaged with a barrel shroud 6, it should be noted that in various embodiments the mount 2 can be rotatably engaged with any suitable part of a firearm, such as a barrel.

The legs 5 in the Figures are shown attaching to the mount 2 at separate locations. In some other embodiments, each leg 5 could also attach to a common support piece, and the common support piece can attach to the mount 2 at one or more locations.

Each embodiment of a mount 2 shown in the Figures comprises a continuous structure that extends completely around the central axis 20 of the mount 2. Thus, the mounts 2 illustrated are tubular or cylindrical in shape. Other embodiments of a mount 2 can have any suitable shape and are not required to form a ring shape. A mount 2 preferably extends around at least a portion of the barrel shroud 6 and is oriented with at least a portion of the mount 2 overlaying the upper half of the barrel shroud (e.g. a portion oriented above a central axis 9 of the barrel shroud 6).

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A firearm support assembly comprising:

a barrel shroud comprising a central axis, an upper portion and a lower portion, the upper portion oriented above the central axis, the lower portion oriented below the central axis;

a mount rotatably engaged with the barrel shroud such that an outer surface of said barrel shroud is engaged with an inner surface of said mount, the mount arranged to rotate around the barrel shroud, at least a portion of the mount overlaying at least a portion of the upper portion of the barrel shroud;

a first leg attached to the mount; and a second leg attached to the mount;

wherein at least one of said outer surface of said barrel shroud and said inner surface of said mount comprises a spherical portion.

2. The firearm support assembly of claim 1, wherein the mount comprises a ring extending around the barrel shroud.

3. The firearm support assembly of claim 1, wherein said inner surface of said mount comprises a socket portion and said outer surface of said barrel shroud comprises a ball portion.

4. The firearm support assembly of claim 1, wherein each leg attaches to the mount at a location above the central axis of the barrel shroud, and each leg extends downwardly past the central axis of the barrel shroud.

5. The firearm support assembly of claim 4, wherein the first leg attaches to the mount at a first location and the second leg attaches to the mount at a second location, the first location defining a first radial line extending from the central axis of the barrel shroud to the first location, the first radial line oriented normal to a longitudinal axis of said first leg, the second location defining a second radial line extending from the central axis of the barrel shroud to the second location, the second radial line oriented normal to a longitudinal axis of said second leg, an angle between the first radial line and the second radial line being less than 140 degrees.

6. The firearm support assembly of claim 1, further comprising a first retaining ring and a second retaining ring, the first retaining ring attached to the barrel shroud on a first side of the mount, the second retaining ring attached to the barrel shroud on a second side of the mount.

7. The firearm support assembly of claim 6, wherein the barrel shroud further comprises a plurality of circumferential grooves, each groove configured to receive a retaining ring.

8. The firearm support assembly of claim 7, wherein the plurality of grooves comprises at least two axially spaced pairs of grooves, and each pair of grooves defines an axial mounting location for the mount.

9. The firearm support assembly of claim 1, further comprising a bearing membrane between the barrel shroud and the mount.

10. The firearm support assembly of claim 1, wherein the mount is configured to swivel with respect to the barrel shroud such that the mount includes a first orientation and a second orientation, an axis of the mount being parallel to the central axis of the barrel shroud in the first orientation, the axis of the mount being nonparallel to the central axis of the barrel shroud in the second orientation.

11. The firearm support assembly of claim 1, wherein each of said outer surface of said barrel shroud and said inner surface of said mount comprises a spherical portion.

12. The firearm support assembly of claim 1, the barrel shroud further comprising an adapter ring, the adapter ring comprising said spherical portion.

13. A firearm support assembly comprising:

a barrel shroud comprising a central axis, an upper portion and a lower portion, the upper portion oriented above the central axis, the lower portion oriented below the central axis;

a mount rotatably engaged with the barrel shroud, the mount arranged to rotate around the barrel shroud, at least a portion of the mount overlaying at least a portion of the upper portion of the barrel shroud;

a first leg attached to the mount; and a second leg attached to the mount;

wherein the mount comprises a first portion and a second portion, the first leg attached to the first portion at a first attachment location, the second leg attached to the second portion at a second attachment location, wherein the first portion is adjustable with respect to the second portion to vary the distance between the first attachment location and the second attachment location.

14. A firearm support assembly comprising:

a mounting ring configured to extend around a gun barrel and to be rotatably engaged with a portion of the firearm, the mounting ring comprising a first portion rotatable with respect to a second portion, the mounting ring defining a central axis; and a first leg and a second leg, each leg attached to the mounting ring at a location above the central axis, each leg extending downwardly below the central axis, the first leg attached to the first portion of said mounting ring at a first attachment location, the second leg attached to the second portion of said mounting ring at a second attachment location;

wherein rotation of the first portion of said mounting ring with respect to said second portion adjusts a distance between said first attachment location and said second attachment location.

15. The firearm support assembly of claim 14, wherein said first portion comprises a plurality of grooves and said second portion comprises a protrusion sized to engage one of said grooves.

16. The firearm support assembly of claim 14 wherein the first attachment location and the second attachment location are less than 140 degrees apart as measured around the mounting ring.

17. The firearm support assembly of claim 14, the first portion comprising a ring and the second portion comprising a ring.

18. The firearm support assembly of claim 14, further comprising a plurality of detents between the first portion and the second portion.

19. The firearm support assembly of claim 14, the mounting ring further comprising a concave inner surface having a spherical shape.

20. The firearm support assembly of claim 14, further comprising a barrel shroud defining a plurality of predetermined engagement locations along its length, the mounting ring rotatably engaged with the barrel shroud at one of said engagement locations.

* * * * *